United States Patent [19]

Kantarian et al.

[11] 4,154,995

[45] May 15, 1979

[54] SWITCH MOUNTING AND ACTUATING APPARATUS

[76] Inventors: Edward T. Kantarian, 4325 Arlington Dr., Royal Oak, Mich. 48072; Donald F. Staub, 814 Fox Run Dr., Bloomfield Hills, Mich. 48013

[21] Appl. No.: 879,785

[22] Filed: Feb. 21, 1978

[51] Int. Cl.[2] ..... H01H 3/16

[52] U.S. Cl. ..... 200/61.41; 198/502; 200/332

[58] Field of Search ..... 200/61.41, 330, 332, 200/153 T; 340/673, 674, 675, 676, 61.43, 61.44; 198/502, 503, 504

[56] References Cited

U.S. PATENT DOCUMENTS 3,291,953 12/1966 Luik ..... 200/330

*Primary Examiner*—J. V. Truhe
*Assistant Examiner*—Morris Ginsburg
*Attorney, Agent, or Firm*—William T. Sevald

[57] ABSTRACT

Unitary switch mounting and actuating apparatus, particularly suitable for use on automatic conveyer systems, comprises a case having a back wall with an aperture formed therein and two spaced side walls. A shaft is pivotally mounted between the side walls opposite the aperture in the back wall. An externally threaded nipple is welded to the back wall over the aperture therein. A radial leg is fixed on the shaft and extends through the aperture and nipple to a contact foot. A radial arm is fixed on the shaft. A torsion spring surrounds the shaft and resiliently urges the leg and arm into the unactuated position. A platform welded to the case supports a switch with its actuation element aligned with the radial arm. Movement of the leg from its unactuated position moves the shaft angularly and swings the radial arm to depress the actuation element of the switch to change the condition of the switch. The apparatus is mounted on a conveyer by locating the nipple in a hole of the conveyer rail and tightening a nut on its threaded portion against the conveyer. This locates the contact foot on the radial leg in the path of items traveling on the conveyer so that the apparatus is actuated when an item moves the contact foot and radial leg.

4 Claims, 5 Drawing Figures

SWITCH MOUNTING AND ACTUATING APPARATUS

BACKGROUND OF THE INVENTION

Automatic conveyers are used industrially, commercially, and in service functions such as the post office. They are controlled by electro-mechanical servo-systems to regulate flow, speed, storage, switching, stopping, starting, etc. These devices have means for sensing and determining the presence or absence of items on the conveyer, such as mail trays in a post office which are used herein as exemplary of items being carried by conveyers.

The devices of the prior art which provide regulation of conveyers are complicated in design and construction, expensive to manufacture, install and relocate, difficult and complicated to mount and remount at other locations, and involve additional work in attaching and adjusting the switches which they actuate.

Conveyers may be hundreds and thousands of feet in length and require many item sensing and determining devices along their length so that the other functions of the conveyer will be properly coordinated with the ambient load conditions of the conveyer.

Thus the prior art devices leave much to be desired as far as initial installation is concerned and also in the relocating of the devices to suit changed conditions as the conveyer control systems must be changed when load conditions change, when new load handling equipment is added, and when space, storage, work, aisle, loading and unloading conditions change.

The prior art sensing devices and the switches which they actuate thus should be improved so that they are more efficient initially and during their worklife.

SUMMARY OF THE PRESENT INVENTION

The switch mounting and actuating apparatus of the present invention provides a unitary switch mounting and actuating assembly which is mountable on a conveyer by a single connection and which is movable to a different location on the conveyor by disconnecting the single connection and remounting the assembly at a new location by reconnecting the single connection.

A hole is provided in the conveyer and an externally threaded nipple is welded on the apparatus. The apparatus is mounted on the conveyer by inserting the nipple in the hole and tightening a nut on the nipple against the conveyer. The apparatus includes the entire operating assembly to sense and determine the presence and/or absence of items on the conveyer at the point of mounting. Thus the entire apparatus is mountable at a point on the conveyer by simply providing a hole in the conveyer in which to insert the nipple. The entire apparatus is movable to a different location on the conveyer by simple removing the nut and remounting it by inserting the nipple in a like hole at the new point and tightening the nut.

The apparatus includes a case having a back wall and spaced side walls. An aperture is formed in the back wall. An externally threaded nipple is welded over the aperture. A shaft is pivotably mounted between the side walls in a position overlying the aperture in the back wall. A first item contacting radial leg is fixed on the shaft and extends through the aperture and the nipple to an engagement foot. A wheel may be mounted on the engagement foot to reduce friction with the item engaged on the conveyer. A second switch actuator radial arm is secured to the shaft. Angular movement of the item contact leg is thus transferred to the switch actuation arm via the shaft. Switch support means, such as a platform, is connected to the back and/or side walls. A switch is mounted on the platform with its actuation element aligned with the switch actuator arm for actuation by the arm.

When an item traveling on the conveyor moves the foot on the engagement leg, the leg swings angularly and pivots the shaft which in turn swings the contact arm against the switch actuation element which changes the condition of the switch thereby sensing and signaling the presence or passing of an item on the conveyer at that point.

The switch mounting and actuating apparatus of the present invention thus solves a long-felt want in the automatic conveyer control art by providing an apparatus which is simple in design and construction, inexpensive to manufacture and maintain, easy to mount, easy to dismount and remount at other locations on the conveyer to suit changed and altered requirements, and reduces the difficulties to minimum in mounting and remounting the switch or switches associated with the actuation apparatus.

The foregoing is described more fully in the detailed description hereinafter set forth taken in connection with the accompanying drawings now described.

DETAILED DESCRIPTION OF THE ILLUSTRATED EMBODIMENTS

Figure 1:
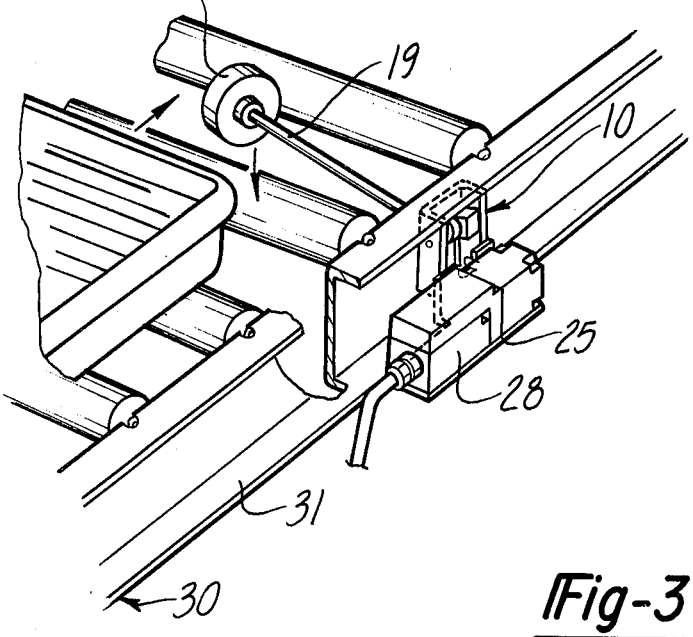
FIG. 1 is a perspective view of the switch mounting and actuating apparatus of the invention in mounted condition on a conveyer showing the apparatus in the ready position for engagement with a tray on the conveyer with the tray and conveyer shown broken away, arrows indicating the direction of travel of the tray and movement of the leg when contacted by the tray and showing switch means actuated by the apparatus.
Figure 3:
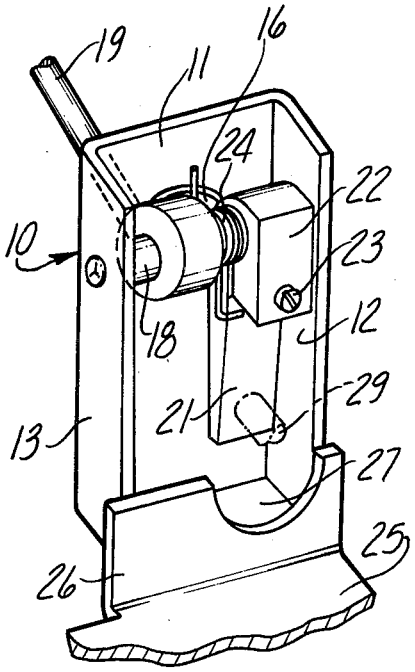
FIG. 3 is an enlarged perspective view of the apparatus of the invention seen in FIGS. 1 and 2 with the conveyer and switch portions removed and the switch platform broken away and in cross-section.
Figure 2:
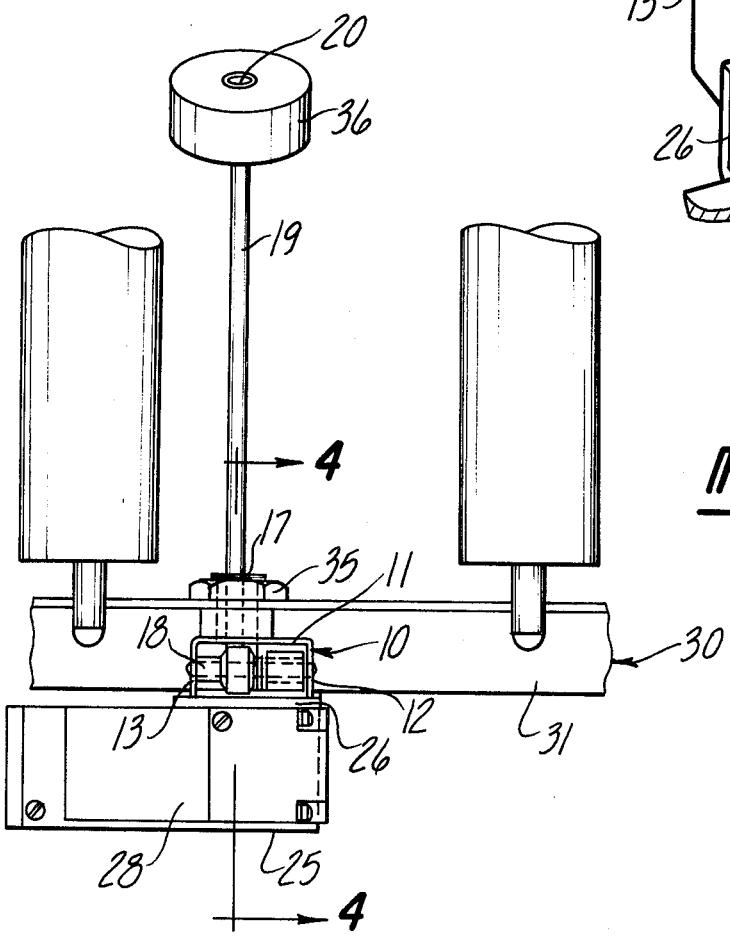
FIG. 2 is a top plan view of a portion of the assembly seen in FIG. 1 showing a portion of the conveyer elements seen in FIG. 1 and providing a top plan view of the apparatus of the invention.
Figure 4:
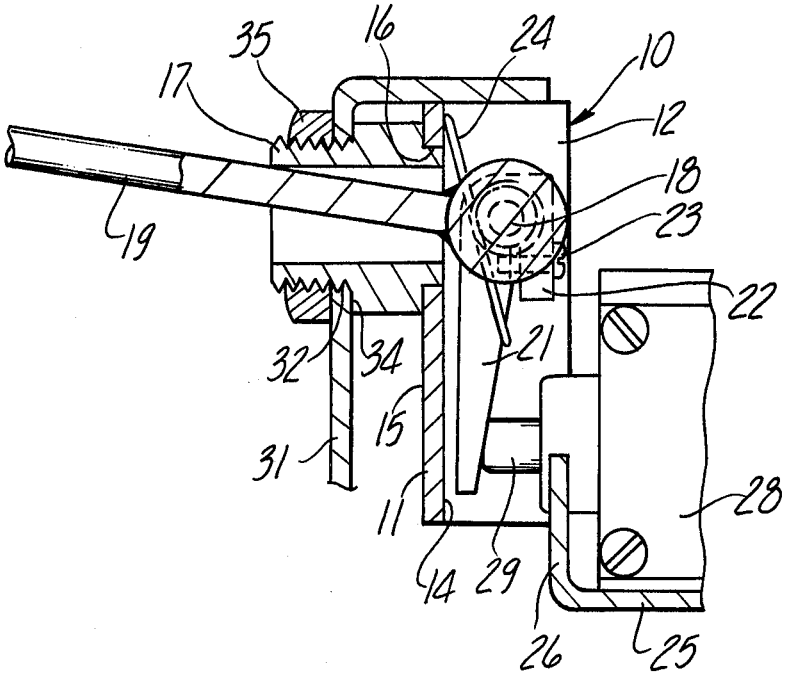
FIG. 4 is an enlarged cross-sectional view of the apparatus of the invention shown in FIG. 2 taken on the line 4—4 thereof with the engagement leg and switch portions broken away and showing the apparatus in the unactuated condition.

Referring now to the drawings wherein like reference numerals refer to like and corresponding parts throughout the several views, the novel switch mounting and actuating apparatus of the invention comprises a case 10 composed of a back wall 11 and paired spaced side walls 12 and 13. The back wall 11 has an inner face 14, an outer face 15, and an aperture 16. A hollow externally threaded nipple 17 is welded to the outer face 15 of the back wall 11 with the nipple 17 aligned over the aperture 16. A shaft 18 is pivotably mounted between the side walls 12 and 13 in a position opposite the aperture 16 and nipple 17. A radial engagement leg 19 is fixed on the shaft 18 and extends through the aperture 16 and nipple 17 to an engagement foot 20 remote from the shaft 18. A wheel 36 is freely turnably mounted on the foot 20, reduces the friction of the foot 20 with items on the conveyer, and increases the angular movement of the leg 19 by the radius of the wheel 36.

A switch actuator radial arm 21 is fixed on the shaft 18. The arm 21 may have a split hub 22 and a screw 23 for tightening the hub 22 of the arm 21 on the shaft 18. A torsion spring 24 surrounds the shaft 18 and engages the arm 21 and the back wall 11 so as to urge the arm 21 inwardly toward the back wall 11 and the leg 19 upwardly as seen in the FIGS. 1–4.

Figure 5:
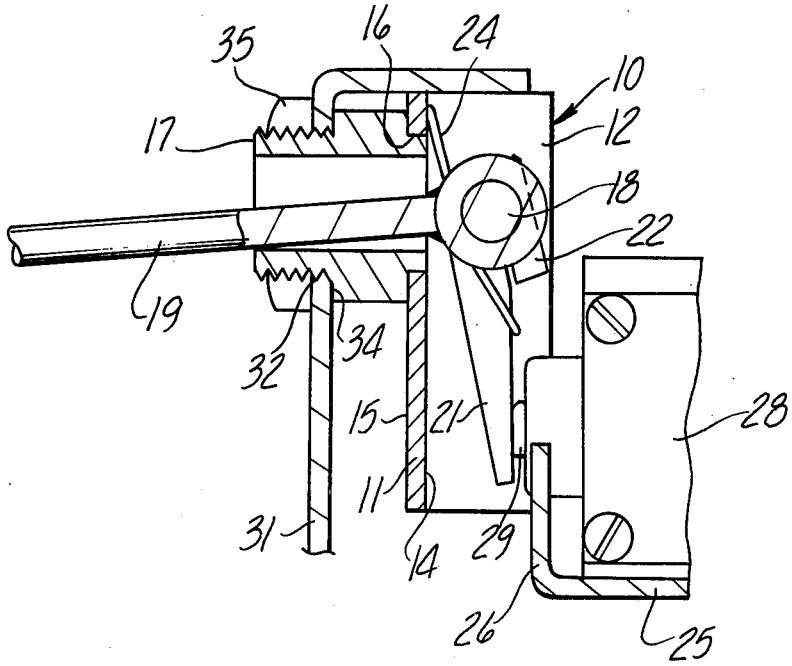
FIG. 5 is a view similar to FIG. 4 showing the apparatus in the actuated condition.

The split hub 22 on the radial arm 21 allows the radial arm 21 to be tightened on the shaft 18 after the radial leg 19 is located in its unactuated position. Thus the leg 19 may be moved downwardly against the resilience of the spring 24 to pivot the shaft 18 and swing the arm 21 outwardly from the back wall 11 as seen in FIG. 5.

A platform 25 has a flange 26 welded to the side walls 12 and 13. A relief 27 is formed in the flange 26 opposite the radial actuator arm 21. A switch 28 is mounted on the platform 25. A switch actuation element 29 on the switch 28 extends from the switch 28 through the relief 27 of the flange 26 and lies in contact with the radial actuator arm 21.

The conveyor 30 has a rail 31. A hole 32 is formed in the conveyor rail 31. To mount the apparatus, the wheel 36 is removed from the leg 19 and the leg 19 and nipple 17 are inserted in the hole 32 until the flange 34 on the nipple 17 abuts the rail 31. A nut 35 is then threaded on the nipple 17 and tightened against the rail 31. A wheel 36 is then replaced on the foot 20 of the leg 19. Preferably, the edges of the back wall 11 and of the side walls 12 and 13 lie in abutting relationship to the inner side of the flange on the rail 31 so that the case cannot pivot about the single connection. This completes mounting the apparatus on the conveyer.

To position the apparatus at a different location on the conveyer 30, another hole 32 is drilled in the rail 31 and the apparatus attached to the rail 31 as previously stated. Reasons for relocating the apparatus are multiple in automatic conveyers as different operations may be more suitable sensed and signaled at different points due to load conditions, storage room, work room, switching operations, drive cut-off, drive connection, etc.. Different loads and/or containers on the conveyer line also require changes in their handling.

The apparatus together with the switch form an integrated unit which is easily, quickly, simply, and securely mounted in the initial location and is just as easily moved to a new location.

While only a preferred embodiment of the invention has been shown and described, it will be understood that modifications of the apparatus may be made within the limits of the appended claims which define the protective scope of the invention.

We claim:

1. Switch mounting and actuating apparatus particularly suitable for automatic conveyers and like systems comprising, a case having a back wall, spaced side walls lying normal to said back wall, and an aperture in said back wall;

said back wall having inner and outer faces;

an externally threaded hollow nipple attached to said outer face of said back wall in surrounding relationship to said aperture in said back wall;

a nut threaded on said nipple, a shaft pivotably mounted between said side walls opposite said aperture in said back wall and adjacent said inner face of said back wall;

a contact leg radially fixed on said shaft and extending through said aperture and said nipple to a cantilevered engagement foot remote from said case;

a switch actuator arm radially fixed on said shaft, a torsion spring on said shaft angularly biasing said shaft in one direction to swing said contact leg to its non-engaging position and said actuator arm to its unactuated position, and means on said case for locating and supporting a switch for actuation by said actuator arm;

said apparatus being mountable on a conveyer and like systems by providing a hole in a conveyer member, removing said nut from said nipple and taking it off said contact leg, inserting said contact leg and nipple in the hole in the conveyer member, replacing said nut over said contact leg, and rethreading said nut on said nipple until said nut tightens against the conveyer member;

said apparatus when so mounted projecting said contact leg into the path of items traveling on the conveyer to engage said engagement foot of said contact leg with items traveling on the conveyer so that the items angularly move said contact leg to swing said shaft against said spring to in turn swing said actuator arm to actuate a switch supported and located on said means.

2. In apparatus as set forth in claim 1, said means comprising a platform mounted on said case;

a switch mounted on said platform having a switch actuation member;

said switch actuation member being aligned with said radial arm for actuation by radial movement of said radial arm, said switch and said switch mounting and actuating apparatus being mountable, dismountable, and remountable as a unit.

3. In apparatus as set forth in claim 1, a wheel on said contact foot of said radial leg for reducing the friction of contact with items traveling on a conveyer and for increasing the angular movement of said leg by the radius of said wheel.

4. In apparatus as set forth in claim 1, said radial arm having a split hub on said shaft and a screw for tightening said split hub on said shaft; said split hub permitting tightening said radial arm on said shaft as positioned by said spring after said radial leg is located in its unactuated position.

* * * * *